US006508927B2

(12) United States Patent
Yanada et al.

(10) Patent No.: US 6,508,927 B2
(45) **Date of Patent: *Jan. 21, 2003**

(54) TIN-COPPER ALLOY ELECTROPLATING BATH

(75) Inventors: Isamu Yanada, Hirakata (JP); Masanobu Tsujimoto, Hirakata (JP); Tetsurou Okada, Hirakata (JP); Teruya Oka, Hirakata (JP); Hideyuki Tsubokura, Hirakata (JP)

(73) Assignee: C. Uyemura & Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/433,887

(22) Filed: Nov. 4, 1999

(65) Prior Publication Data

US 2002/0104763 A1 Aug. 8, 2002

(30) Foreign Application Priority Data

Nov. 5, 1998 (JP) ..... 10-314210
May 7, 1999 (JP) ..... 11-127648

(51) Int. Cl.[7] ..... C25D 3/58
(52) U.S. Cl. ..... 205/241; 205/253; 205/254
(58) Field of Search ..... 205/241, 253, 205/254

(56) References Cited

U.S. PATENT DOCUMENTS

| | | | | |
|---|---|---|---|---|
| 4,347,107 A | * | 8/1982 | Teichmann et al. | 205/241 |
| 4,389,286 A | | 6/1983 | McCoy | |
| 4,582,576 A | | 4/1986 | Opaskar et al. | |
| 5,118,394 A | | 6/1992 | Makino et al. | |
| 5,385,661 A | | 1/1995 | Andricacos et al. | |
| 5,435,838 A | | 7/1995 | Melton et al. | |
| 5,948,235 A | * | 9/1999 | Arai | 205/252 |
| 6,099,713 A | * | 8/2000 | Yanada et al. | 205/253 |

FOREIGN PATENT DOCUMENTS

EP 0 829 557 A1 3/1998

* cited by examiner

*Primary Examiner*—Nam Nguyen
*Assistant Examiner*—Wesley A. Nicolas
(74) *Attorney, Agent, or Firm*—Sughrue Mion, PLLC

(57) ABSTRACT

A tin-copper alloy electroplating bath which comprises a water-soluble tin salt, a water-soluble copper salt, an inorganic or organic acid or a water-soluble salt thereof, and one or more compounds selected from thioamide compounds and thiol compounds. The present invention makes it possible to form a tin-copper alloy deposit, in place of tin-lead alloy plating, on electronic parts such as chips, quartz crystal oscillators, hoops, connector pins, lead frames, bumps, lead pins of packages, and printed circuit boards.

19 Claims, No Drawings

TIN-COPPER ALLOY ELECTROPLATING BATH

BACKGROUND OF THE INVENTION

1. Field of the Invention

The present invention relates to a tin-copper alloy electroplating bath and a plating process therewith, the tin-copper alloy electroplating being useful as a substitute for tin-lead alloy (solder) plating.

2. Description of the Related Arts

It has been common practice to perform tin plating or tin-lead alloy plating, prior to soldering, on such parts of electronic machines and equipment as chips, quartz crystal oscillators, bumps, connector pins, lead frames, hoops, lead pins of packages, and printed circuit boards.

In the production of printed circuit boards, tin plating or tin-lead alloy plating film has been widely used as an etching resist film.

Stricter regulations are being enforced which restrict the use of lead for environmental protection. This has aroused a demand for lead-free plating baths which will supersede tin-lead alloy plating baths. This demand is not met by simple tin plating baths because tin deposit would deteriorate in solderability and would cause crystalline whiskers to occur in the plating film.

Attempts have been made to develop new kinds of plating with a tin alloy.

Tin-copper alloy plating is attracting attention. The conventional tin-copper alloy plating baths deposit a tin-copper alloy containing copper more than 50 wt %. The plating bath for tin-copper alloy is a strong alkaline bath which uses alkali cyanide or alkali pyrophosphate as a complexing agent, or a simple bath which is based on sulfuric acid and contains no complexing agent. The former is disclosed in Japanese Patent Laid-open No. 27590/1996. These plating baths, however, do not serve as a substitute for tin plating baths or tin-lead alloy plating baths applied to electronic parts and printed circuit boards. This is because they do not form tin-copper alloy plating film containing 0.01–10 wt % of copper required when applied to electronic parts and printed circuit boards. In addition, the plating bath should be neutral or acidic if it is to be applied to printed circuit boards or the like covered with an organic resist film which is liable to peel off in an alkaline plating bath. Although simple baths based on sulfuric acid are strongly acidic, they have the disadvantage of causing soluble tin or tin-copper alloy anodes to liberate tin from their surface and deposit copper on their surface when not energized. This makes it difficult to control the plating bath adequately. In addition, these plating baths readily precipitate tin compounds and hence lack long-term stability.

SUMMARY OF THE INVENTION

The present invention was completed in view of the foregoing. It is an object of the present invention to provide a tin-copper alloy electroplating bath as a substitute for the conventional tin-lead alloy plating bath. This tin-copper alloy electroplating bath imparts good solderability to various parts to be soldered or forms plating film of tin-copper alloy which serves as an etching resist. It is another object of the present invention to provide a process for plating with the tin-copper alloy electroplating bath.

The tin-copper alloy electroplating bath of the first aspect of the present invention comprises a water-soluble tin salt, a water-soluble copper salt, an inorganic or organic acid or a water-soluble salt thereof, and one or more compounds selected from thioamide compounds and thiol compounds.

The tin-copper alloy electroplating bath of the second aspect of the present invention comprises a water-soluble tin salt, a water-soluble copper salt, one or more compounds selected from carboxylic acids, lactone compounds, condensed phosphoric acids, phosphonic acids and water-soluble salts thereof, one or more compounds selected from thioamide compounds and thiol compounds, and an inorganic or organic acid or a water-soluble salt thereof other than carboxylic acids, lactone compounds, condensed phosphoric acids, phosphonic acids and water-soluble salts thereof.

The tin-copper alloy electroplating bath of the present invention gives plating film as a substitute for tin or tin-lead alloy plating film which is used for soldering or as an etching resist. It can be applied to any parts constituting electronic machines and equipment, such as chips, quartz crystal oscillators, bumps, connector pins, lead frames, hoops, lead pins of packages, and printed circuit boards, which need lead-free soldering.

The tin-copper alloy electroplating bath of the present invention permits a broad range of cathode current density and gives satisfactory plating film of tin-copper alloy when used in barrel plating, rack plating, or rackless plating (jet or flow high-speed plating). It can be applied to electronic parts made up of conducting materials having insulating materials such as ceramics, lead glass, plastics and ferrite incorporated therein without adverse effect such as corrosion, deformation, and degradation on insulating materials. It does not cause displacement deposition or precede deposition of copper to occur on the soluble anode of tin or tin-copper alloy or on the plating film. This is advantageous to plating operation.

DESCRIPTION OF THE PREFERRED EMBODIMENTS

The invention will be described in more detail in the following.

According to the present invention, the tin-copper alloy electroplating bath contains a water-soluble tin salt, a water-soluble copper salt, an inorganic or organic acid or a water-soluble salt thereof, and one or more compounds selected from thioamide compounds and thiol compounds.

The tin salt may be either stannous salt or stannic salt. The stannous salt [Sn (II) salt] includes, for example, stannous organosulfonate (such as stannous methanesulfonate), stannous sulfate, stannous chloride, stannous bromide, stannous iodide, stannous oxide, stannous phosphate, stannous pyrophosphate, stannous acetate, stannous citrate, stannous gluconate, stannous tartrate, stannous lactate, stannous succinate, stannous sulfamate, stannous borofluoride, stannous formate, and stannous silicofluoride. The stannic salt [Sn (IV) salt] includes, for example, sodium stannate and potassium stannate.

The copper salt may be either cuprous salt or cupric salt. The cuprous salt [copper (I) salt] includes, for example, cuprous oxide, cuprous cyanide, cuprous chloride, cuprous bromide, cuprous iodide and cuprous thiocyanate. The cupric salt [copper (II) salt] includes, for example, cupric organosulfonate (such as cupric methanesulfonate), cupric sulfate, cupric chloride, cupric bromide, cupric iodide, cupric oxide, cupric phosphate, cupric pyrophosphate, cupric acetate, cupric citrate, cupric gluconate, cupric tartrate, cupric lactate, cupric succinate, cupric sulfamate, cupric borofluoride, cupric formate, and cupric silicofluoride.

The content of tin salt in the plating bath should preferably be 1–99 g/L, particularly 5–59 g/L in terms of tin, and the content of copper salt in the plating bath should preferably be 0.001–99 g/L, particularly 0.01–54 g/L in terms of copper. For obtaining a tin-copper alloy deposit containing 0.01–30 wt % of copper, the content of tin salt should preferably be 1–99 g/L, particularly 5–59 g/L in terms of tin and the content of copper salt should preferably be 0.001–30 g/L, particularly 0.01–18 g/L in terms of copper.

Examples of the inorganic or organic acid include sulfuric acid, hydrochloric acid, nitric acid, hydrofluoric acid, fluoroboric acid, phosphoric acid, sulfamic acid, sulfonic acid such as aliphatic sulfonic acid and aromatic sulfonic acid, carboxylic acid such as aliphatic saturated carboxylic acid, aromatic carboxylic acid, and aminocarboxylic acid, condensed phosphoric acid and phosphonic acid.

Examples of the aliphatic or aromatic sulfonic acid include substituted or unsubstituted alkanesulfonic acid, hydroxyalkanesulfonic acid, benzenesulfonic acid, and naphthalenesulfonic acid. The unsubstituted alkanesulfonic acid may be one which is represented by $C_n H_{2n+1}SO_3H$ (where n is 1–5, preferably 1 or 2).

The unsubstituted hydroxyalkanesulfonic acid may be one which is represented by the formula below.

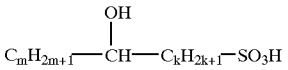

(where m is 0–2 and k is 1–3.)

The substituted alkanesulfonic acid or hydroxyalkanesulfonic acid may be one in which hydrogen atoms of the alkyl group are partly replaced by halogen atom, aryl groups, alkylaryl groups, carboxyl groups, or sulfonic acid groups.

The benzenesulfonic acid and naphthalenesulfonic acid are represented by the following formulas respectively.

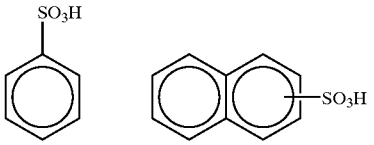

The substituted benzenesulfonic acid and naphthalenesulfonic acid may be those in which hydrogen atoms of the benzene or naphthalene ring are partly replaced by hydroxyl groups, halogen atom, alkyl groups, carboxyl groups, nitro groups, mercapto groups, amino groups, or sulfonic acid groups.

Specific examples include methanesulfonic acid, ethanesulfonic acid, isethionic acid, propanesulfonic acid, 2-propanesulfonic acid, butanesulfonic acid, 2-butanesulfonic acid, pentanesulfonic acid, chloropropanesulfonic acid, 2-hydroxyethane-1-sulfonic acid, 2-hydroxypropanesulfonic acid, 2-hydroxybutane-1-sulfonic acid, 2-hydroxypentanesulfonic acid, allylsulfonic acid, 2-sulfoacetic acid, 2-sulfopropionic acid, 3-sulfopropionic acid, sulfosuccinic acid, sulfomaleic acid, sulfofumaric acid, benzenesulfonic acid, toluenesulfonic acid, xylenesulfonic acid, nitrobenzenesulfonic acid, sulfobenzoic acid, sulfosalicylic acid, benzaldehyde-sulfonic acid, and p-phenolsulfonic acid.

The carboxylic acid used should preferably be one which does not have aliphatic unsaturated bonds. Examples of the aliphatic saturated carboxylic acids include monocarboxylic acids such as formic acid, acetic acid, lactic acid, propionic acid, butyric acid, and gluconic acid, dicarboxylic acids such as oxalic acid, malonic acid, succinic acid, tartaric acid, and malic acid, and tricarboxylic acids such as citric acid and tricarballylic acid. Examples of the aromatic carboxylic acids include phenylacetic acid, benzoic acid, and anisic acid. Examples of the aminocarboxylic acids include iminodiacetic acid, nitrilotriacetic acid (NTA), ethylenediamine tetraacetic acid (EDTA), and diethylenetriamine pentaacetic acid. Examples of the condensed phosphoric acids include pyrophosphoric acid, tripolyphosphoric acid, tetrapolyphosphoric acid, polyphosphoric acid having a degree of polymerization of 5 or more, and hexametaphosphoric acid. Examples of the phosphonic acids include aminotrimethylene phosphonic acid, 1-hydroxyethylidene-1,1-diphosphonic acid, ethylenediamine tetramethylenephosphonic acid, and diethylenetriamine pentamethylenephosphonic acid.

Examples of the salts of the inorganic and organic acids include alkali metal salts such as sodium salt, potassium salt and lithium salt, alkali earth metal salts such as magnesium salt, calcium salt and barium salt, divalent tin (stannous) salts, tetravalent tin (stannic) salts, monovalent copper (cuprous) salts, divalent copper (cupric) salts, ammonium salts, and organic amine salts such as monomethylamine salt, dimethylamine salt, trimethylamine salt, ethylamine salt, isopropylamine salt, ethylenediamine salt and diethylenetriamine salt.

The content of the inorganic or organic acid or the water-soluble salt thereof in the plating bath should preferably be at least 50 g/L, preferably at least 100 g/L, and should preferably be 600 g/L or less, more preferably 500 g/L or less, much more preferably 400 g/L or less, most preferably 300 g/L or less. If the content is smaller than that mentioned above, the plating bath is unstable and liable to precipitate. The effect levels off even though the content exceeds the above-mentioned limit.

In the present invention, it is preferable that (A) at least one compound selected from carboxylic acids, condensed phosphoric acids, phosphonic acids and the water-soluble salts thereof as well as lactone compounds such as gluconolactone and gluconoheptolactone and (B) at least one compound selected from inorganic or organic acids and the water-soluble salts other than the component (A) (carboxylic acids, lactone compounds, condensed phosphoric acids, phosphonic acids and the water-soluble salts thereof) are used in combination. The component (B) includes sulfuric acid, hydrochloric acid, nitric acid, hydrofluoric acid, fluoroboric acid, phosphoric acid, sulfamic acid, sulfonic acids described above, and the water-soluble salt thereof.

The component (A), i.e., carboxylic acid, lactone compound, condensed phosphoric acid, phosphonic acid and the water-soluble salt thereof, may be used singly or in combination. Among them, citric acid, tartaric acid, succinic acid, gluconic acid, malic acid, EDTA, NTA, malonic acid, and the water-soluble salts thereof should preferably be used. The content of the component (A) should preferably be in the range of 50 to 500 g/L, preferably 50 to 300 g/L, more preferably 100 to 300 g/L. If the content is too small, the plating bath may be unstable and liable to precipitate. The effect levels off even though the content is too much. When a surfactant is added to the plating bath, it may not be fully dissolved therein, resulting in salting-out, if the content is too much.

The component (B) may preferably be sulfuric acid, hydrochloric acid, nitric acid and the water-soluble salts thereof. Among the water-soluble salts, potassium salts, sodium salts, ammonium salts and magnesium salts are preferred. The content of the component (B) should be in the range of 5 to 200 g/L, preferably 30 to 200 g/L, more preferably 30 to 100 g/L. If the content is too small, the alloy ratio of tin and copper in the deposit may become unstable and the bath voltage may become higher when barrel plating is conducted. The effect levels off even though the content is too much. When a surfactant is added to the plating bath, it may not be fully dissolved therein, resulting in salting-out, if the content is too much.

The component (B) would act, when used in combination with the component (A), as an electrically conducting salt for the plating bath and a stabilizer for an alloy composition of the deposit.

According to the present invention, the plating bath contains one or more members selected from thioamide compounds and thiol compounds as a bath stabilizer or complexing agent. Examples of the thioamide compounds or thiol compounds include thioamide compounds having 1–15 carbon atoms such as thiourea, dimethylthiourea, diethylthiourea, trimethylthiourea, N,N'-diisopropylthiourea, acetylthiourea, allylthiourea, ethylenethiourea, 1,3-diphenylthiourea, thiourea dioxide, thiosemicarbazide, and tetramethylthiourea and thiol compounds having 2–8 carbon atoms such as mercaptoacetic acid (thioglycolic acid), mercaptosuccinic acid (thiomalic acid) and mercaptolactic acid. Among them, thiourea, dimethylthiourea, diethylthiourea, trimethylthiourea, N,N'-diisopropylthiourea, acetylthiourea, allylthiourea, ethylenethiourea, 1,3-diphenylthiourea, thiourea dioxide, thiosemicarbazide, tetramethylthiourea, mercaptosuccinic acid, mercaptolactic acid, thioglycolic acid, and the water-soluble salts (e.g., alkali metal salts, ammonium salts, magnesium salts, etc.) thereof are preferred.

The content of thioamide compound or thiol compound in the plating bath should preferably be 1–200 g/L, particularly 5–100 g/L. They will not fully produce their effect if their amount is excessively small; they will prevent the formation of fine crystals in the plating film if their amount is excessively large.

The plating bath of the present invention may be incorporated with a nonionic surface active agent if necessary.

A nonionic surface active agent helps the Sn—Cu alloy deposition with a smooth dense surface and with a uniform composition. It should preferably be one which is derived from alkylene oxide. It includes, for example, polyoxyethylene β-naphthol ether, ethylene oxide-propylene oxide block copolymer, polyoxyethylene alkyl ether, polyoxyethylene phenyl ether, polyoxyethylene alkylamino ether, polyoxyethylene fatty acid ester, polyoxyethylene polyhydric alcohol ether, and polyethylene glycol. Its amount in the plating bath should preferably be 0.01–50 g/L, particularly 2–10 g/L. It may cause burnt deposits due to high current density if its amount is excessively small, and it may cause the plating film to assume a blackish color or uneven color if its amount is excessively large.

The plating bath of the present invention may be incorporated with one or more of cationic surface active agents, anionic surface active agents, and amphoteric surface active agents, if necessary.

Examples of the cationic surface active agents include dodecyltrimethyl ammonium salt, hexadecyltrimethyl ammonium salt, octadecyltrimethyl ammonium salt, dodecyldimethylethyl ammonium salt, octadecenyldimethylethyl ammonium salt, dodecyldimethyl ammonium betaine, octadecyldimethyl ammonium betaine, dimethylbenzyldodecyl ammonium salt, hexadecyldimethylbenzyl ammonium salt, octadecyldimethylbenzyl ammonium salt, trimethylbenzyl ammonium salt, triethylbenzyl ammonium salt, hexadecyl pyridinium salt, dodecyl pyridinium salt, dodecyl picolinium salt, dodecyl imidazolium salt, oleyl imidazolium salt, octadecylamine acetate, and dodecylamine acetate.

Examples of the anionic surface active agents include alkyl sulfate, polyoxyethylene alkyl ether sulfate, polyoxyethylene alkylphenyl ether sulfate, alkylbenzenesulfonate, and (poly)alkylnaphthalenesulfonate. Examples of the alkyl sulfonate include sodium dedecylsulfate and sodium oleyl sulfate. Examples of the polyoxyethylene alkyl ether sulfate include sodium polyoxyethylene (EO12) nonyl ether sulfate and sodium polyoxyethylene (EO15) dodecyl ether sulfate.

Examples of the amphoteric surface active agents include betaine, sulfobetaine, and imidazolium betaine. Additional examples include sulfated adduct or sulfonated adduct of a condensation product of ethylene oxide and/or propylene oxide with alkylamine or diamine.

The amount of these surface active agents in the plating bath should preferably be 0–50 g/L, preferably 0.01–50 g/L, particularly 2–10 g/L.

The plating bath of the present invention may be incorporated with one or more of mercapto group-containing aromatic compounds, dioxyaromatic compounds, and unsaturated carboxylic acid compounds, as a leveling agent for the plating film and an antioxidant for $Sn^{2+}$ion in the plating bath. Examples of the mercapto group-containing aromatic compounds include 2-mercaptobenzoic acid, mercaptophenol, 2-mercaptobenzoxazole, 2-mercaptobenzothiazole, 2-mercaptoethylamine, and mercaptopyridine. Examples of the dioxyaromatic compounds include dioxybenzophenone, 3,4-dioxyphenylalanine, resorcin, catechol, hydroquinone, dioxyhexane, and dipalin. Examples of the unsaturated carboxylic acid compounds include benzoic acid, fumaric acid, phthalic acid, acrylic acid, citraconic acid, and methacrylic acid. The amount of these components in the plating bath should preferably be 0.001–20 g/L, particularly 0.001–5 g/L.

The plating bath of the present invention may be incorporated with one or more of aldehyde compounds as a brightener for a plating film. Examples of the aldehyde compounds include 1-naphthaldehyde, 2-naphthaldehyde, o-chlorobenzaldehyde, m-chlorobenzaldehyde, p-chlorobenzaldehyde, 2,4-dichlorobenzaldehyde, acetaldehyde, salicylaldehyde, 2-thiophenaldehyde, 3-thiophenaldehyde, o-anisaldehyde, m-anisaldehyde, p-anisaldehyde, and salicylaldehyde allyl ether. The aldehyde compound may preferably be added in an amount of 0.001–10 g/L, especially 0.05–0.5 g/L.

The plating bath of the present invention may preferably be incorporated with one or more of water-soluble metal salts selected from water-soluble gold salts, water-soluble silver salts, water-soluble zinc salts, water-soluble bismus salts, water-soluble nickel salts, water-soluble cobalt salts, and water-soluble palladium salts. The incorporation of the water-soluble metal salt can form a dense ternary alloy of Sn—Cu—Au, Ag, Zn, Bi, Ni, Co or Pd due to the codeposition of the metal (Au, Ag, Zn, Bi, Ni, Co or Pd) with Sn and Cu, or the water-soluble metal salt can act as an additive for forming a dense deposit, improving a solderability, and preventing the deposit from discoloring after heat treatment.

Examples of the water-soluble metal salts include sodium aurous [gold (I)] sulfite, silver (I) chloride, silver (I) sulfate, silver (I) methanesulfonate, zinc oxide, zinc sulfate, zinc chloride, bismus (III) oxide, bismus (III) sulfate, bismus (III) methanesulfonate, nickel (II) chloride, nickel (II) sulfate, nickel (II) sulfamate, cobalt (II) chloride, cobalt (II) sulfate, cobalt (II) sulfamate, palladium (II) chloride, and palladium (II) sulfate.

The content of the water-soluble metal salt may preferably be 0.001 to 99 g/L, especially 0.005 to 18 g/L. The water-soluble metal salt can improve the solderability of the deposit and prevent the deposit from discoloring after heat treatment even in a small amount of 0.001 to 2 g/L, preferably 0.001 to 1 g/L, more preferably 0.005 to 1 g/L.

The plating bath of the present invention should preferably have a pH value of 10 or less, preferably 9 or less, more preferably 7 or less. The lower limit of pH is not limited. When the compound selected from carboxylic acids, lactone compounds, condensed phosphoric acids, phosphonic acids and the water-soluble salts thereof (the component (A) described above) is used in combination with at least one compound selected from the inorganic and organic acids and the water-soluble salts thereof other than the component (A), the pH of the plating bath should preferably be 2 or more, especially 4 or more.

The plating bath is effective for plating electronic parts having an insulating material such as glass, ceramic and plastic incorporated therein, since the plating bath can be used at a pH of 2 or more. The insulating portion of the electronic part may be attacked, denatured or deformed if the plating bath has a pH of lower than 2.0.

The plating bath of the present invention may be applied to rack plating, barrel plating, or high-speed plating in the usual way. The cathode current density may be established in the range of 0.01–100 A/dm$^2$, especially 0.01–20 A/dm$^2$. It may be 0.5–5 A/dm$^2$, particularly 1–4 A/dm$^2$, for rack plating. It may be 0.01–1 A/dm$^2$, particularly 0.05–0.5 A/dm$^2$, for barrel plating. The plating temperature is preferably 10–50° C., particularly 15–40° C. Agitation, which is optional, may be accomplished by cathode rocking, stirring, or pumping. The anode may be a soluble one, i.e., tin, copper, or tin alloy containing at least one metal selected from copper, gold, silver, zinc, bismus, nickel, cobalt, and palladium. The use of the soluble anode can supplement the required metal ions depending to the metal contained in the anode. The content of the metal alloyed with tin depends on the amount of the metal ions required in the plating bath. The anode may also be an insoluble one, such as carbon and platinum. Incidentally, the plating bath of the present invention will not cause displacement deposition of copper on the tin anode or tin-copper alloy anode even when it is not energized. The cathode current efficiency is usually 80–99%.

The plating bath of the present invention may be applied to any objects having conducting parts capable of electroplating. Such objects may be composite parts composed of a conducting material such as metal and an insulating material such as ceramics, lead glass, plastics, and ferrite. These objects for plating may undergo pretreatment suitable for individual materials. The plating bath of the present invention does not cause displacement deposition or precede deposition of copper to occur on the plating film. In addition, it does not cause corrosion, deformation, and degradation to insulating materials when it is applied to electronic parts composed of conducting materials and insulating materials.

To be concrete, the plating bath of the present invention may be used to form tin-copper alloy deposit on electronic parts which need soldering, such as chips, quartz crystal oscillators, connector pins, lead frames, hoops, package lead pins and bumps, and printed circuit boards.

The plating bath of the present invention gives a plating film of tin-copper alloy which varies in appearance from white to grayish white and from bright to matte, depending on the content of copper and the presence or absence of brightening components and/or the water-soluble metal salts. According to the present invention, a tin-copper alloy consisting of 99.99 to 10 wt % of tin and 0.01 to 90 wt % of copper, depending on the ratio of tin ions and copper ions in the plating bath and the plating conditions. The alloy composition should be selected according to the intended use. For soldering or for etching resist, the content of tin should be more than 50 wt %, preferably more than 70 wt %, and more preferably more than 90 wt %, and the content of copper should be more than 0.01 wt %, preferably more than 0.1 wt %.

When the above-said component (A) and the above-said component (B) is used in combination, the alloy composition of Sn and Cu is more stabilized in the Cu content range of 0.5±0.2 to 10.0±0.5 wt % at a cathode current density of 0.01 to 0.5 A/dm$^2$, and therefore the combination of the components (A) and (B) is effective for barrel plating which is conducted in a cathode current density of 0.01 to 0.5 A/dm$^2$ in average.

EXAMPLES

The invention will be described in more detail with reference to the following examples and comparative examples, which are not intended to restrict the scope thereof.

Example and Comparative Example I

Tin-copper alloy plating baths were prepared according to the compositions shown in Tables 1 and 2. Lead frames of copper or iron-nickel (42) alloy which had been pretreated in the usual way were dipped in the plating baths, and electroplating by rack plating method was carried out, with the lead frames serving as cathodes, under the conditions shown in Tables 1 and 2. The pH of the plating bath was adjusted by using sulfuric acid solution or sodium hydroxide solution.

The plating film was examined for some characteristics. The results are shown in Tables 1 and 2.

TABLE 1

| | Examples | | | | | | | | | |
|---|---|---|---|---|---|---|---|---|---|---|
| Component (g/L) | 1 | 2 | 3 | 4 | 5 | 6 | 7 | 8 | 9 | 10 |
| Tin (II) sulfate (as $Sn^{2+}$) | 9.5 | 9.8 | 18 | 7 | 59 | 0 | 0 | 0 | 0 | 0 |
| Copper (II) sulfate 5 hydrate (as $Cu^{2+}$) | 0.5 | 0.2 | 2 | 3 | 1 | 0 | 0 | 0 | 0 | 0 |
| Tin (II) methanesulfonate (as $Sn^{2+}$) | 0 | 0 | 0 | 0 | 0 | 9.95 | 9.7 | 16 | 9.9 | 58 |
| Copper (II) methanesulfonate (as $Cu^{2+}$) | 0 | 0 | 0 | 0 | 0 | 0.05 | 0.3 | 4 | 0.1 | 2 |

TABLE 1-continued

| Component (g/L) | Examples 1 | 2 | 3 | 4 | 5 | 6 | 7 | 8 | 9 | 10 |
|---|---|---|---|---|---|---|---|---|---|---|
| Sulfuric acid | 100 | 50 | 0 | 0 | 200 | 0 | 0 | 0 | 0 | 0 |
| Methanesulfonic acid | 0 | 0 | 0 | 0 | 0 | 100 | 50 | 0 | 0 | 200 |
| Sodium gluconate | 0 | 200 | 0 | 0 | 0 | 0 | 200 | 0 | 0 | 0 |
| Triammonium citrate | 0 | 0 | 200 | 0 | 0 | 0 | 0 | 200 | 0 | 0 |
| Tetrapotassium pyrophosphate | 0 | 0 | 0 | 200 | 0 | 0 | 0 | 0 | 200 | 0 |
| Thiourea | 25 | 25 | 0 | 0 | 150 | 50 | 25 | 0 | 0 | 150 |
| Dimethylthiourea | 0 | 0 | 50 | 0 | 0 | 0 | 0 | 0 | 0 | 0 |
| Acetylthiourea | 0 | 0 | 0 | 25 | 0 | 0 | 0 | 0 | 0 | 0 |
| Mercaptosuccinic acid | 0 | 25 | 0 | 25 | 0 | 0 | 0 | 0 | 25 | 0 |
| Mercaptolactic acid | 0 | 0 | 0 | 0 | 0 | 0 | 25 | 0 | 0 | 0 |
| Thioglycolic acid | 0 | 0 | 0 | 0 | 0 | 0 | 0 | 50 | 0 | 0 |
| Polyoxyethylene β-naphthol ether (number of moles of EO added = 10) | 5 | 0 | 0 | 0 | 0 | 5 | 0 | 0 | 0 | 0 |
| Sodium hexylalkyl sulfate ester | 0 | 2.5 | 2.5 | 0 | 0 | 0 | 2.5 | 2.5 | 0 | 0 |
| Dodecyltrimethylammonium chloride | 0 | 0 | 0 | 2.5 | 0 | 0 | 0 | 0 | 2.5 | 0 |
| Dimethylalkyl betaine | 2.5 | 0 | 0 | 0 | 2.5 | 0 | 0 | 0 | 0 | 0 |
| Ethylene oxide-propylene oxide block copolymer (Mw = 2500, EO/PO = 6/4) | 0 | 0 | 0 | 0 | 2.5 | 0 | 0 | 0 | 0 | 5 |
| Polyoxyethylene stearylaminoether (number of moles of EO added = 15) | 0 | 2.5 | 2.5 | 0 | 0 | 0 | 2.5 | 2.5 | 0 | 0 |
| Polyethylene glycol (ave. Mw = 3000) | 0 | 0 | 0 | 2.5 | 0 | 0 | 0 | 0 | 2.5 | 0 |
| 1-Naphthaldehyde | 0.1 | 0.2 | 0.5 | 0.2 | 0 | 0.1 | 0.2 | 0.5 | 0.2 | 0 |
| pH (note 1) | <1 | 4 | 7 | 9 | <1 | <1 | 4 | 7 | 9 | <1 |
| Cathode current density ($A/dm^2$) | 2 | 0.5 | 1 | 2 | 10 | 0.5 | 2 | 1 | 2 | 10 |
| Plating time (minutes) | 10 | 40 | 20 | 10 | 2 | 40 | 10 | 20 | 10 | 2 |
| Bath temperature (° C.) | 25 | 25 | 25 | 50 | 30 | 25 | 25 | 25 | 50 | 30 |
| Anode (note 2) | A | A | A | A | B | A | A | A | A | B |
| Agitation (note 3) | a | a | a | a | b | a | a | a | a | b |
| Appearance of plating film (note 4) | ○ | ○ | Δ | Δ | ○ | ○ | ○ | Δ | Δ | ○ |
| Stability of Sn/Cu deposition ratio of plating film (note 5) | ○ | Δ | Δ | Δ | ○ | ○ | Δ | Δ | Δ | ○ |
| Solderability (note 6) | ○ | ○ | Δ | Δ | ○ | ○ | Δ | Δ | Δ | ○ |
| Cu content (wt %) | 5.4 | 2.2 | 9.1 | 6.5 | 1.6 | 0.7 | 3.2 | 22 | 1.2 | 1.4 |

TABLE 2

| Component (g/L) | Comparative Examples 1 | 2 | 3 | 4 | 5 | 6 | 7 | 8 | 9 | 10 |
|---|---|---|---|---|---|---|---|---|---|---|
| Tin (II) sulfate (as $Sn^{2+}$) | 19 | 0 | 57 | 0 | 0 | 0 | 0 | 0 | 9.8 | 0 |
| Copper (II) sulfate 5 hydrate (as $Cu^{2+}$) | 1 | 0 | 3 | 0 | 0 | 0 | 0 | 0 | 0.2 | 0 |
| Tin (II) methanesulfonate (as $Sn^{2+}$) | 0 | 19 | 0 | 57 | 0 | 0 | 0 | 0 | 0 | 16 |
| Copper (II) methanesulfonate (as $Cu^{2+}$) | 0 | 1 | 0 | 3 | 0 | 0 | 0 | 0 | 0 | 4 |
| Sodium stannate (IV) 3 hydrate (as $Sn^{4+}$) | 0 | 0 | 0 | 0 | 38 | 48 | 0 | 0 | 0 | 0 |
| Copper (I) cyanide (as $Cu^{+}$) | 0 | 0 | 0 | 0 | 2 | 12 | 0 | 0 | 0 | 0 |
| Tin (II) pyrophosphate (as $Sn^{2+}$) | 0 | 0 | 0 | 0 | 0 | 0 | 9.5 | 18 | 0 | 0 |
| Copper (II) pyrophosphate (as $Cu^{2+}$) | 0 | 0 | 0 | 0 | 0 | 0 | 0.5 | 2 | 0 | 0 |
| Sulfuric acid | 100 | 0 | 200 | 0 | 0 | 0 | 0 | 0 | 50 | 0 |
| Methanesulfonic acid | 0 | 100 | 0 | 200 | 0 | 0 | 0 | 0 | 0 | 0 |
| Sodium cyanide | 0 | 0 | 0 | 0 | 50 | 100 | 0 | 0 | 0 | 0 |
| Sodium hydroxide | 0 | 0 | 0 | 0 | 100 | 200 | 0 | 0 | 0 | 0 |
| Tetrapotassium pyrophosphate | 0 | 0 | 0 | 0 | 0 | 0 | 100 | 200 | 0 | 0 |
| Sodium gluconate | 0 | 0 | 0 | 0 | 0 | 0 | 0 | 0 | 200 | 0 |
| Triammonium citrate | 0 | 0 | 0 | 0 | 0 | 0 | 0 | 0 | 0 | 180 |
| Sodium alkyl sulfate ester | 2 | 4 | 10 | 10 | 10 | 10 | 5 | 10 | 5 | 10 |
| pH (note 1) | <1 | <1 | <1 | <1 | 12 | 13 | 9 | 9 | 4 | 7 |
| Cathode current density ($A/dm^2$) | 2 | 2 | 10 | 10 | 5 | 10 | 2 | 4 | 0.5 | 2 |
| Plating time (minutes) | 10 | 10 | 2 | 2 | 4 | 2 | 10 | 5 | 40 | 10 |
| Bath temperature (° C.) | 25 | 25 | 30 | 30 | 55 | 55 | 25 | 25 | 30 | 30 |
| Anode (note 2) | A | A | B | B | C | C | C | C | A | A |
| Agitation (note 3) | a | a | b | b | a | a | a | a | a | a |
| Appearance of plating film (note 4) | X | X | X | X | X | X | X | X | X | X |
| Stability of Sn/Cu deposition ratio of plating film (note 5) | X | X | X | X | X | X | X | X | X | X |

TABLE 2-continued

| Component (g/L) | Comparative Examples 1 | 2 | 3 | 4 | 5 | 6 | 7 | 8 | 9 | 10 |
|---|---|---|---|---|---|---|---|---|---|---|
| Solderability (note 6) | X | X | X | Δ | X | X | Δ | X | Δ | X |
| Cu content (wt %) | 4.8 | 5.3 | 9.4 | 6.5 | 4.6 | 16.5 | 3.9 | 8.3 | 1.6 | 21.4 |

Note 1. pH
The pH of the plating solution was adjusted with sulfuric acid solution or sodium hydroxide solution.
Note 2. Anode
A: tin-copper alloy
B: platinum-plated titanium
C: carbon
Note 3. Agitation
a: by cathode rocking
b: by jetting of plating solution
Note 4. Appearance of plating film
○: uniform and dense
Δ: slightly uneven color
X: uneven color and burnt deposits
Note 5. Stability of Sn/Cu deposition ratio of plating film
○: within ±10% of variation in Sn/Cu deposition ratio due to the variation of cathode current density used
Δ: within ±30% of variation in Sn/Cu deposition ratio due to the variation of cathode current density used
X: within ±50% of variation in Sn/Cu deposition ratio due to the variation of cathode current density used
Note 6. Solderability
◎: the same solderability as that of Sn—Pb alloy plating film
○: solderability which is intermediate between Sn—Pb alloy plating film and Sn plating film
Δ: the same solderability as that of Sn plating film
X: solderability which is inferior to that of Sn plating film

Example and Comparative Example II

Tin-copper alloy plating baths were prepared according to the compositions shown in Tables 3 and 4. Lead frames of copper or iron-nickel (42) alloy which had been pretreated in the usual way were dipped in the plating baths, and electroplating by rack plating method was carried out, with the lead frames serving as cathodes, under the conditions shown in Tables 3 and 4. The pH of the plating bath was adjusted by using sulfuric acid solution or sodium hydroxide solution.

The plating film was examined for some characteristics. The results are shown in Tables 3 and 4.

TABLE 3

| Component (g/L) | Examples 11 | 12 | 13 | 14 | 15 | 16 | 17 | 18 | 19 | 20 |
|---|---|---|---|---|---|---|---|---|---|---|
| Tin (II) sulfate (as $Sn^{2+}$) | 9.5 | 9.8 | 19.9 | 9.9 | 38 | 0 | 0 | 0 | 0 | 0 |
| Copper (II) sulfate 5 hydrate (as $Cu^{2+}$) | 0.5 | 0 | 0 | 0.1 | 0 | 0 | 0 | 0 | 0 | 0 |
| Copper (I) oxide (as $Cu^{+}$) | 0 | 0.2 | 0.1 | 0 | 2 | 0 | 0 | 0 | 0.1 | 0 |
| Tin (II) methanesulfonate (as $Sn^{2+}$) | 0 | 0 | 0 | 0 | 0 | 9.95 | 9.7 | 16 | 9.9 | 58 |
| Copper (II) methanesulfonate (as $Cu^{2+}$) | 0 | 0 | 0 | 0 | 0 | 0.05 | 0.3 | 4 | 0 | 2 |
| Sodium gluconate | 200 | 150 | 0 | 0 | 0 | 0 | 200 | 0 | 0 | 0 |
| Triammonium citrate | 0 | 0 | 250 | 200 | 0 | 0 | 0 | 0 | 100 | 0 |
| Tetrapotassium pyrophosphate | 0 | 0 | 0 | 0 | 0 | 100 | 0 | 250 | 0 | 0 |
| Magnesium 1-hydroxyethylidene-1,1-diphosphonate | 0 | 0 | 0 | 0 | 300 | 0 | 0 | 0 | 0 | 400 |
| Thiourea | 50 | 25 | 0 | 25 | 150 | 10 | 50 | 0 | 0 | 150 |
| Dimethylthiourea | 0 | 0 | 25 | 0 | 0 | 0 | 0 | 200 | 25 | 0 |
| Sodium sulfate | 50 | 0 | 100 | 0 | 0 | 0 | 50 | 0 | 0 | 0 |
| Ammonium methanesulfonate | 0 | 0 | 0 | 0 | 0 | 200 | 0 | 100 | 0 | 30 |
| Potassium sulfate | 0 | 100 | 0 | 200 | 50 | 0 | 0 | 0 | 0 | 0 |
| Magnesium methanesulfonate | 0 | 0 | 0 | 0 | 0 | 0 | 150 | 0 | 120 | 0 |
| Polyoxyethylene β-naphthol ether (number of moles of EO added = 10) | 0 | 0 | 2.5 | 5 | 0 | 5 | 5 | 2.5 | 2.5 | 0 |
| Ethylene oxide-propylene oxide block copolymer (Mw = 2500, EO/PO = 6/4) | 5 | 5 | 0 | 0 | 5 | 0 | 0 | 0 | 0 | 10 |
| 1-Naphthaldehyde | 0.1 | 0 | 0.5 | 0 | 0.5 | 0.2 | 0 | 0 | 0 | 0.5 |
| o-Chlorobenzaldehyde | 0 | 0.2 | 0 | 0.5 | 0 | 0 | 0.1 | 0.5 | 0.2 | 0 |
| pH (note 1) | 2.0 | 3.0 | 4.0 | 5.0 | 6.0 | 7.0 | 8 | 9 | 4.5 | 5.5 |
| Cathode current density ($A/dm^2$) | 0.2 | 0.1 | 0.3 | 1 | 10 | 0.05 | 2 | 1 | 0.1 | 20 |
| Plating time (minutes) | 100 | 200 | 70 | 20 | 2 | 400 | 10 | 20 | 10 | 1 |
| Bath temperature (° C.) | 25 | 25 | 30 | 15 | 30 | 25 | 35 | 25 | 30 | 30 |
| Bath stability (note 2) | ○ | ○ | ○ | ○ | ○ | ○ | ○ | ○ | ○ | ○ |
| Appearance of plating film (note 3) | ○ | ○ | ○ | ○ | ○ | ○ | ○ | Δ | Δ | ○ |
| Cu content (wt %) | 5.4 | 2.2 | 1.0 | 0.5 | 4.2 | 0.7 | 3.2 | 22 | 1.2 | 1.4 |

TABLE 4

| Component (g/L) | Comparative Examples 11 | 12 | 13 | 14 | 15 | 16 | 17 | 18 | 19 | 20 |
|---|---|---|---|---|---|---|---|---|---|---|
| Tin (II) sulfate (as $Sn^{2+}$) | 19 | 0 | 24 | 0 | 0 | 0 | 0 | 0 | 9.8 | 0 |
| Copper (II) sulfate 5 hydrate (as $Cu^{2+}$) | 1 | 0 | 6 | 0 | 0 | 0 | 0 | 0 | 0.2 | 0 |
| Tin (II) methanesulfonate (as $Sn^{2+}$) | 0 | 9.9 | 0 | 57 | 0 | 0 | 0 | 0 | 0 | 16 |
| Copper (II) methanesulfonate (as $Cu^{2+}$) | 0 | 0.1 | 0 | 3 | 0 | 0 | 0 | 0 | 0 | 4 |
| Sodium stannate (IV) 3 hydrate (as $Sn^{4+}$) | 0 | 0 | 0 | 0 | 38 | 48 | 0 | 0 | 0 | 0 |
| Copper (I) cyanide (as $Cu^{+}$) | 0 | 0 | 0 | 0 | 2 | 12 | 0 | 0 | 0 | 0 |
| Tin (II) pyrophosphate (as $Sn^{2+}$) | 0 | 0 | 0 | 0 | 0 | 0 | 9.5 | 19.5 | 0 | 0 |
| Copper (II) pyrophosphate (as $Cu^{2+}$) | 0 | 0 | 0 | 0 | 0 | 0 | 0.5 | 0.5 | 0 | 0 |
| Methanesulfonic acid | 0 | 0 | 0 | 150 | 0 | 0 | 0 | 0 | 0 | 0 |
| Sodium cyanide | 0 | 0 | 0 | 0 | 50 | 100 | 0 | 0 | 0 | 0 |
| Sodium hydroxide | 0 | 0 | 0 | 0 | 100 | 200 | 0 | 0 | 0 | 0 |
| Sodium gluconate | 200 | 0 | 0 | 0 | 0 | 0 | 0 | 0 | 200 | 0 |
| Triammonium citrate | 0 | 100 | 0 | 0 | 0 | 0 | 0 | 0 | 0 | 180 |
| Tetrapotassium pyrophosphate | 0 | 0 | 300 | 0 | 0 | 0 | 120 | 200 | 0 | 0 |
| Sodium alkyl sulfate ester | 2 | 4 | 5 | 10 | 10 | 10 | 5 | 10 | 5 | 10 |
| pH (note 1) | 4 | 2 | 6 | <1 | 12 | 13 | 9 | 9 | 4 | 7 |
| Cathode current density ($A/dm^2$) | 0.2 | 0.05 | 1 | 20 | 5 | 10 | 2 | 4 | 0.5 | 0.1 |
| Plating time (minutes) | 100 | 400 | 20 | 1 | 4 | 2 | 10 | 5 | 40 | 200 |
| Bath temperature (° C.) | 25 | 30 | 15 | 25 | 55 | 55 | 25 | 25 | 25 | 25 |
| Bath stability (note 2) | X | X | X | X | X | X | X | X | X | X |
| Appearance of plating film (note 3) | X | X | X | X | X | X | X | X | X | X |
| Cu content (wt %) | 4.8 | 1.3 | 18 | 2.5 | 4.6 | 16.5 | 3.9 | 8.3 | 1.6 | 21.4 |

Note 1. pH
The pH of the plating bath was adjusted with sulfuric acid solution or sodium hydroxide solution.
Note 2. Bath stability
○: good bath stability; no precipitation occurred
X: bad bath stability; precipitation is liable to occur
Note 3. Appearance of plating film
○: uniform and even
Δ: slightly uneven
X: uneven
Note 4. Anode: tin-copper alloy

Example III

Tin-copper alloy plating baths were prepared according to the compositions shown in Tables 5 and 6. Lead frames of copper or iron-nickel (42) alloy which had been pretreated in the usual way were dipped in the plating baths, and electroplating was carried out, with the lead frames serving as cathodes, under the conditions shown in Tables 5 and 6. The pH of the plating bath was adjusted by using sulfuric acid solution or sodium hydroxide solution.

The plating film was examined for some characteristics. The results are shown in Tables 5 and 6.

TABLE 5

| Component (g/L) | Examples 21 | 22 | 23 | 24 | 25 | 26 | 27 | 28 | 29 | 30 |
|---|---|---|---|---|---|---|---|---|---|---|
| Tin (II) sulfate (as $Sn^{2+}$) | 9.5 | 9.8 | 18 | 7 | 59 | 0 | 0 | 0 | 0 | 0 |
| Copper (II) sulfate 5 hydrate (as $Cu^{2+}$) | 0.5 | 0 | 0 | 3 | 1 | 0 | 0 | 0 | 0 | 0 |
| Copper (I) oxide (as $Cu^{+}$) | 0 | 0.2 | 2 | 0 | 0 | 0 | 0.3 | 0 | 0 | 0 |
| Tin (II) methanesulfonate (as $Sn^{2+}$) | 0 | 0 | 0 | 0 | 0 | 9.95 | 9.7 | 16 | 9.9 | 58 |
| Copper (II) methanesulfonate (as $Cu^{2+}$) | 0 | 0 | 0 | 0 | 0 | 0.05 | 0.3 | 4 | 0.1 | 2 |
| Sulfuric acid | 100 | 50 | 0 | 0 | 200 | 0 | 0 | 0 | 0 | 0 |
| Methanesulfonic acid | 0 | 0 | 0 | 0 | 0 | 100 | 50 | 0 | 0 | 200 |
| Sodium gluconate | 0 | 200 | 0 | 0 | 0 | 0 | 200 | 0 | 0 | 0 |
| Triammonium citrate | 0 | 0 | 200 | 0 | 0 | 0 | 0 | 0 | 0 | 0 |
| Tetrapotassium pyrophosphate | 0 | 0 | 0 | 200 | 0 | 0 | 0 | 0 | 200 | 0 |
| Magnesium 1-hydroxyethylidene-1,1-diphosphonate | 0 | 0 | 0 | 0 | 0 | 0 | 0 | 300 | 0 | 0 |
| Thiourea | 25 | 25 | 0 | 0 | 150 | 50 | 25 | 0 | 0 | 150 |
| Dimethylthiourea | 0 | 0 | 50 | 0 | 0 | 0 | 0 | 0 | 0 | 0 |
| Acetylthiourea | 0 | 0 | 0 | 25 | 0 | 0 | 0 | 0 | 0 | 0 |
| Mercaptosuccinic acid | 0 | 25 | 0 | 25 | 0 | 0 | 0 | 0 | 25 | 0 |
| Mercaptolactic acid | 0 | 0 | 0 | 0 | 0 | 0 | 25 | 0 | 0 | 0 |
| Thioglycolic acid | 0 | 0 | 0 | 0 | 0 | 0 | 0 | 50 | 0 | 0 |
| Sodium sulfate | 0 | 100 | 0 | 50 | 0 | 0 | 0 | 0 | 0 | 0 |
| Ammonium methanesulfonate | 0 | 0 | 0 | 0 | 0 | 0 | 80 | 0 | 60 | 0 |
| Potassium sulfate | 0 | 0 | 100 | 0 | 0 | 0 | 0 | 0 | 0 | 0 |
| Magnesium methanesulfonate | 0 | 0 | 0 | 0 | 0 | 0 | 0 | 120 | 0 | 0 |
| Nickel (II) sulfate 6 hydrate (as $Ni^{2+}$) | 0.1 | 0 | 0 | 0.05 | 0 | 0 | 0.3 | 0 | 0.1 | 0 |

TABLE 5-continued

| Component (g/L) | Examples 21 | 22 | 23 | 24 | 25 | 26 | 27 | 28 | 29 | 30 |
|---|---|---|---|---|---|---|---|---|---|---|
| Silver (I) sulfate (as $Ag^{2+}$) | 0 | 0.1 | 0 | 0 | 0.05 | 0 | 0 | 1 | 0 | 0.2 |
| Bismus (III) sulfate (as $Bi^{3+}$) | 0 | 0 | 0.02 | 0 | 0 | 0.01 | 0 | 0 | 0 | 0 |
| Polyoxyethylene β-naphthol ether (number of moles of EO added = 10) | 5 | 0 | 0 | 0 | 0 | 5 | 0 | 0 | 0 | 0 |
| Sodium hexylalkyl sulfate ester | 0 | 2.5 | 2.5 | 0 | 0 | 0 | 2.5 | 2.5 | 0 | 0 |
| Dodecyltrimethylammonium chloride | 0 | 0 | 0 | 2.5 | 0 | 0 | 0 | 0 | 2.5 | 0 |
| Dimethylalkyl betaine | 2.5 | 0 | 0 | 0 | 2.5 | 0 | 0 | 0 | 0 | 0 |
| Ethylene oxide-propylene oxide block copolymer (Mw = 2500, EO/PO = 6/4) | 0 | 0 | 0 | 0 | 2.5 | 0 | 0 | 0 | 0 | 5 |
| Polyoxyethylene stearylaminoether (number of moles of EO added = 15) | 0 | 2.5 | 2.5 | 0 | 0 | 0 | 2.5 | 2.5 | 0 | 0 |
| Polyethylene glycol (ave. Mw = 3000) | 0 | 0 | 0 | 2.5 | 0 | 0 | 0 | 0 | 2.5 | 0 |
| 1-Naphthaldehyde | 0.1 | 0.2 | 0.5 | 0.2 | 0 | 0.1 | 0.2 | 0.5 | 0.2 | 0 |
| pH (note 1) | <1 | 4 | 7 | 9 | <1 | <1 | 4 | 7 | 9 | <1 |
| Cathode current density ($A/dm^2$) | 2 | 0.2 | 1 | 2 | 10 | 0.1 | 2 | 1 | 2 | 20 |
| Plating time (minutes) | 10 | 100 | 20 | 10 | 2 | 200 | 10 | 20 | 10 | 2 |
| Bath temperature (° C.) | 25 | 25 | 25 | 50 | 30 | 25 | 25 | 25 | 50 | 30 |
| Anode (note 2) | A | A | A | A | B | A | A | A | A | B |
| Agitation (note 3) | a | c | a | a | b | c | a | a | a | b |
| Appearance of plating film (note 4) | ○ | ○ | ○ | ○ | ○ | ○ | ○ | ○ | ○ | ○ |
| Stability of Sn/Cu deposition ratio of plating film (note 5) | ○ | ○ | ○ | ○ | ○ | ○ | ○ | ○ | ○ | ○ |
| Solderability (note 6) | ◎ | ◎ | ○ | ○ | ◎ | ◎ | ◎ | ○ | ◎ | ◎ |
| Cu content (wt %) | 5.2 | 2.0 | 8.8 | 6.4 | 1.7 | 0.9 | 3.0 | 19 | 1.1 | 1.5 |

TABLE 6

| Component (g/L) | Examples 31 | 32 | 33 | 34 | 35 | 36 | 37 | 38 | 39 | 40 |
|---|---|---|---|---|---|---|---|---|---|---|
| Tin (II) sulfate (as $Sn^{2+}$) | 9.5 | 9.8 | 18 | 7 | 59 | 0 | 0 | 0 | 0 | 0 |
| Copper (II) sulfate 5 hydrate (as $Cu^{2+}$) | 0.5 | 0 | 0 | 3 | 1 | 0 | 0 | 0 | 0 | 0 |
| Copper (I) oxide (as $Cu^{+}$) | 0 | 0.2 | 2 | 0 | 0 | 0 | 0.3 | 0 | 0 | 0 |
| Tin (II) methanesulfonate (as $Sn^{2+}$) | 0 | 0 | 0 | 0 | 0 | 9.95 | 9.7 | 16 | 9.9 | 58 |
| Copper (II) methanesulfonate (as $Cu^{2+}$) | 0 | 0 | 0 | 0 | 0 | 0.05 | 0.3 | 4 | 0.1 | 2 |
| Sulfuric acid | 100 | 50 | 0 | 0 | 200 | 0 | 0 | 0 | 0 | 0 |
| Methanesulfonic acid | 0 | 0 | 0 | 0 | 0 | 100 | 50 | 0 | 0 | 200 |
| Sodium gluconate | 0 | 200 | 0 | 0 | 0 | 0 | 200 | 0 | 0 | 0 |
| Triammonium citrate | 0 | 0 | 200 | 0 | 0 | 0 | 0 | 0 | 0 | 0 |
| Tetrapotassium pyrophosphate | 0 | 0 | 0 | 200 | 0 | 0 | 0 | 0 | 200 | 0 |
| Magnesium 1-hydroxyethylidene-1,1-diphosphonate | 0 | 0 | 0 | 0 | 0 | 0 | 0 | 300 | 0 | 0 |
| Thiourea | 25 | 25 | 0 | 0 | 150 | 50 | 25 | 0 | 0 | 150 |
| Dimethylthiourea | 0 | 0 | 50 | 0 | 0 | 0 | 0 | 0 | 0 | 0 |
| Acetylthiourea | 0 | 0 | 0 | 25 | 0 | 0 | 0 | 0 | 0 | 0 |
| Mercaptosuccinic acid | 0 | 25 | 0 | 25 | 0 | 0 | 0 | 0 | 25 | 0 |
| Mercaptolactic acid | 0 | 0 | 0 | 0 | 0 | 0 | 25 | 0 | 0 | 0 |
| Thioglycolic acid | 0 | 0 | 0 | 0 | 0 | 0 | 0 | 50 | 0 | 0 |
| Sodium sulfate | 0 | 100 | 0 | 50 | 0 | 0 | 0 | 0 | 0 | 0 |
| Ammonium methanesulfonate | 0 | 0 | 0 | 0 | 0 | 0 | 80 | 0 | 60 | 0 |
| Potassium sulfate | 0 | 0 | 100 | 0 | 0 | 0 | 0 | 0 | 0 | 0 |
| Magnesium methanesulfonate | 0 | 0 | 0 | 0 | 0 | 0 | 0 | 120 | 0 | 0 |
| Polyoxyethylene β-naphthol ether (number of moles of EO added = 10) | 5 | 0 | 0 | 0 | 0 | 5 | 0 | 0 | 0 | 0 |
| Sodium hexylalkyl sulfate ester | 0 | 2.5 | 2.5 | 0 | 0 | 0 | 2.5 | 2.5 | 0 | 0 |
| Dodecyltrimethylammonium chloride | 0 | 0 | 0 | 2.5 | 0 | 0 | 0 | 0 | 2.5 | 0 |
| Dimethylalkyl betaine | 2.5 | 0 | 0 | 0 | 2.5 | 0 | 0 | 0 | 0 | 0 |
| Ethylene oxide-propylene oxide block copolymer (Mw = 2500, EO/PO = 6/4) | 0 | 0 | 0 | 0 | 2.5 | 0 | 0 | 0 | 0 | 5 |
| Polyoxyethylene stearylaminoether (number of moles of EO added = 15) | 0 | 2.5 | 2.5 | 0 | 0 | 0 | 2.5 | 2.5 | 0 | 0 |
| Polyethylene glycol (ave. Mw = 3000) | 0 | 0 | 0 | 2.5 | 0 | 0 | 0 | 0 | 2.5 | 0 |
| 1-Naphthaldehyde | 0.1 | 0.2 | 0.5 | 0.2 | 0 | 0.1 | 0.2 | 0.5 | 0.2 | 0 |
| pH (note 1) | <1 | 4 | 7 | 9 | <1 | <1 | 4 | 7 | 9 | <1 |
| Cathode current density ($A/dm^2$) | 2 | 0.2 | 1 | 2 | 10 | 0.1 | 2 | 1 | 2 | 20 |
| Plating time (minutes) | 10 | 100 | 20 | 10 | 2 | 200 | 10 | 20 | 10 | 2 |
| Bath temperature (° C.) | 25 | 25 | 25 | 50 | 30 | 25 | 25 | 25 | 50 | 30 |
| Anode (note 2) | A | A | A | A | B | A | A | A | A | B |
| Agitation (note 3) | a | c | a | a | b | c | a | a | a | b |
| Appearance of plating film (note 4) | ○ | ○ | ○ | ○ | ○ | ○ | ○ | ○ | ○ | ○ |

TABLE 6-continued

| Component (g/L) | Examples | | | | | | | | | |
|---|---|---|---|---|---|---|---|---|---|---|
| | 31 | 32 | 33 | 34 | 35 | 36 | 37 | 38 | 39 | 40 |
| Stability of Sn/Cu deposition ratio of plating film (note 5) | ○ | ○ | ○ | ○ | ○ | ○ | ○ | ○ | ○ | ○ |
| Solderability (note 6) | ○ | ○ | Δ | Δ | ○ | ○ | ○ | Δ | ○ | ○ |
| Cu content (wt %) | 5.4 | 2.1 | 9.0 | 6.3 | 1.6 | 0.7 | 3.1 | 20 | 1.0 | 1.4 |

Note 1. pH
The pH of the plating solution was adjusted with sulfuric acid solution or sodium hydroxide solution.
Note 2. Anode
A: tin-copper alloy
B: platinum-plated titanium
Note 3. Agitation
a: by cathode rocking
b: by jetting of plating solution
c: by barrel plating
Note 4. Appearance of plating film
○: uniform and dense
Δ: slightly uneven color
X: uneven color and burnt deposits
Note 5. Stability of Sn/Cu deposition ratio of plating film
○: within ±10% of variation in Sn/Cu deposition ratio due to the variation of cathode current density used
Δ: within ±30% of variation in Sn/Cu deposition ratio due to the variation of cathode current density used
X: within ±50% of variation in Sn/Cu deposition ratio due to the variation of cathode current density used
Note 6. Solderability
◎: the same solderability as that of Sn—Pb alloy plating film
○: solderability which is intermediate between Sn—Pb alloy plating film and Sn plating film
Δ: the same solderability as that of Sn plating film
X: solderability which is inferior to that of Sn plating film As is described above, the present invention makes it possible to form a tin-copper alloy deposit, in place of tin-lead alloy plating, on electronic parts such as chips, quartz crystal oscillators, hoops, connector pins, lead frames, bumps, lead pins of packages, and printed circuit boards.

What is claimed is:

1. A tin-copper alloy electroplating bath comprising a water-soluble tin salt, a water-soluble copper salt, an inorganic or organic acid other than condensed phosphoric acids or a water-soluble salt thereof, and one or more compounds selected from thiourea compounds and thiol compounds and having a pH value of less than 10.

2. A tin-copper alloy electroplating bath comprising a water-soluble tin salt, a water-soluble copper salt, one or more compounds selected from carboxylic acids, lactone compounds, phosphonic acids and water-soluble salts thereof, one or more compounds selected from thiourea compounds and thiol compounds, and an inorganic or organic acid or a water-soluble salt thereof other than carboxylic acids, lactone compounds, condensed phosphoric acids, phosphonic acids and water-soluble salts thereof and having a pH value of less than 10.

3. A plating bath as defined in claim 2, wherein the compound selected from carboxylic acids, lactone compounds, phosphonic acids and water-soluble salts thereof is formic acid, acetic acid, lactic acid, propionic acid, butyric acid, gluconic acid, oxalic acid, malonic acid, succinic acid, tartaric acid, malic acid, citric acid, tricarballylic acid, phenylacetic acid, benzoic acid, anisic acid, iminodiacetic acid, nitrilotriacetic acid, ethylenediamine tetraacetic acid, diethylenetriamine pentaacetic acid, gluconolactone, gluconoheptolactone, aminotrimethylene phosphonic acid, 1-hydroxyethylidene- 1,1 diphosphonic acid, ethylenediamine tetramethylenephosphonic acid, diethylenetriamine pentamethylenephosphonic acid, or a water-soluble salt thereof.

4. A plating bath as defined in claim 2, wherein the inorganic or organic acid or water-soluble salt thereof is sulfuric acid, hydrochloric acid, nitric acid, hydrofluoric acid, fluoroboric acid, phosphoric acid, sulfamic acid, methanesulfonic acid, ethanesulfonic acid, isethionic acid, propanesulfonic acid, 2-propanesulfonic acid, butanesulfonic acid, 2-butanesulfonic acid, pentanesulfonic acid, chloropropanesulfonic acid, 2-hydroxyethane-1-sulfonic acid, 2-hydroxypropanesulfonic acid, 2-hydroxybutane-1-sulfonic acid, 2-hydroxypentanesulfonic acid, allylsulfonic acid, 2-sulfoacetic acid, 2-sulfopropionic acid, 3-sulfopropionic acid, sulfosuccinic acid, sulfomaleic acid, sulfofumaric acid, benzenesulfonic acid, toluenesulfonic acid, xylenesulfonic acid, nitrobenzenesulfonic acid, sulfobenzoic acid, sulfosalicylic acid, benzaldehydesulfonic acid, p-phenolsulfonic acid, or a water-soluble salt thereof.

5. A plating bath as defined in claim 1 or 2, wherein the water-soluble copper salt is cuprous (I) oxide, cuprous (I) cyanide, cuprous (I) chloride, cuprous (I) bromide, cuprous (I) iodide, or cuprous (I) thiocyanate.

6. A plating bath as defined in claim 1 or 2, wherein the compound selected from thiourea compounds and thiol compounds is at least one selected from the group consisting of thiourea, dimethylthiourea, diethylthiourea, trimethylthiourea, N,N'-diisopropylthiourea, acetylthiourea, allylthiourea, ethylenethiourea, 1, 3-diphenylthiourea, thiourea dioxide, thiosemicarbazide, tetramethylthiourea, mercaptosuccinic acid, mercaptolactic acid, thioglycolic acid, and the water-soluble salts thereof.

7. A plating bath as defined in claim 1 or 2, which further comprises a nonionic surface active agent.

8. A plating bath as defined in claim 1 or 2, which further comprises one or more surface active agents selected from cationic surface active agents, anionic surface active agents, and amphoteric surface active agents.

9. A plating bath as defined in claim 1 or 2, which further comprises one or more additives selected from mercapto group-containing aromatic compounds, dioxyaromatic compounds, and unsaturated carboxylic acid compounds as a leveling agent for the surface of a plating film.

10. A plating bath as defined in claim 1 or 2, which further comprises one or more aldehyde compounds selected from 1-naphthaldehyde, 2-naphthaldehyde, o-chlorobenzaldehyde, m-chlorobenzaldehyde, p-chlorobenzaldehyde, 2,4-dichlorobenzaldehyde, acetaldehyde, salicylaldehyde, 2-thiophenaldehyde, 3-thiophenaldehyde, o-anisaldehyde, m-anisaldehyde, p-anisaldehyde, and salicylaldehyde allyl ether as a brightener for the surface of a plating film.

11. A plating bath as defined in claim 1 or 2, which further comprises one or more water-soluble metal salts selected from the group consisting of water-soluble gold salts, water-soluble silver salts, water-soluble zinc salts, water-soluble bismuth salts, water-soluble nickel salts, water-soluble cobalt salts, and water-soluble palladium salts.

12. A tin-copper alloy electroplating bath having a pH value of less than 1.0 and comprising a water-soluble tin salt, a water-soluble copper salt, an inorganic or organic acid other than condensed phosphoric acids or a water-soluble salt thereof, and one or more compounds selected from thiourea compounds and thiol compounds.

13. A process for tin-copper alloy electroplating which comprises plating an object with the plating bath comprising a water-soluble tin salt, a water-soluble copper salt, an inorganic or organic acid other than condensed phosphoric acids or a water-soluble salt thereof, and one or more compounds selected from thiourea compounds and thiol compounds and having a pH value of less than 10.

14. A process for tin-copper alloy electroplating as defined in claim 13, wherein an anode immersed in the plating bath is made of tin or a tin alloy containing one or more metals selected from the group consisting of copper, gold, silver, zinc, bismuth, nickel, cobalt, and palladium.

15. A tin-copper alloy electroplating bath having a pH value of from 2.0 to 7.0 and comprising a water-soluble tin salt, a water-soluble copper salt, one or more compounds selected from carboxylic acids, lactone compounds, phosphonic acids and water-soluble salts thereof, one or more compounds selected from thiourea compounds and thiol compounds, and an inorganic or organic acid or a water-soluble salt thereof other than carboxylic acids, lactone compounds, condensed phosphoric acids, phosphonic acids and water-soluble salts thereof.

16. A plating bath as defined in claim 12 or 15 wherein the compound selected from thiourea compounds and thiol compounds is at least one selected from the group consisting of thiourea, dimethylthiourea, diethylthiourea, trimethylthiourea, N,N'-diisopropylthiourea, acetylthiourea, allylthiourea, ethylenethiourea, 1,3- diphenylthiourea, thiourea dioxide, thiosemicarbazide, tetramethylthiourea, mercaptosuccinic acid, mercaptolactic acid, thioglycolic acid, and the water-soluble salts thereof.

17. A plating bath as defined in claim 2 or 15, wherein the compound selected from thiourea compounds and thiol compounds is at least one selected from the group consisting of dimethylthiourea, diethylthiourea, trimethylthiourea, N,N'- diisopropylthiourea, acetylthiourea, allylthiourea, ethylenethiourea, 1,3-diphenylthiourea, thiourea dioxide, thiosemicarbazide, tetramethylthiourea, mercaptosuccinic acid, mercaptolactic acid, thioglycolic acid, and the water-soluble salts thereof.

18. A process for tin-copper alloy electroplating which comprises plating an object with the plating bath comprising a water-soluble tin salt, a water-soluble copper salt, one or more compounds selected from carboxylic acids, lactone compounds, phosphonic acids and water-soluble salts thereof, one or more compounds selected from thiourea compounds and thiol compounds, and an inorganic or organic acid or a water-soluble salt thereof other than carboxylic acids, lactone compounds, condensed phosphoric acids, phosphonic acids and water-soluble salts thereof and having a pH value of less than 10.

19. A process for tin-copper alloy electroplating as defined in claim 18, wherein an anode immersed in the plating bath is made of tin or a tin alloy containing one or more metals selected from the group consisting of copper, gold, silver, zinc, bismuth, nickel, cobalt and palladium.

* * * * *